United States Patent [19]

Seino et al.

[11] 4,311,776

[45] Jan. 19, 1982

[54] ELECTROPHOTOGRAPHIC IMAGE FORMING METHOD

[75] Inventors: Kuniki Seino, Aichi; Yoshihiro Ozaki, Isehara, both of Japan

[73] Assignee: Minolta Camera Kabushiki Kaisha, Osaka, Japan

[21] Appl. No.: 28,310

[22] Filed: Apr. 9, 1979

[30] Foreign Application Priority Data

Apr. 13, 1978 [JP] Japan ..... 53/43944

[51] Int. Cl.[3] ..... G03G 13/22

[52] U.S. Cl. ..... 430/48; 430/55; 430/126

[58] Field of Search ..... 361/212, 225; 430/48, 430/55, 902, 31; 355/3 TE, 3 CH; 250/319.1

[56] References Cited

U.S. PATENT DOCUMENTS

| | | | |
|---|---|---|---|
| 2,777,957 | 1/1957 | Walkup | 430/48 |
| 2,825,814 | 3/1958 | Walkup | 430/55 |
| 2,904,431 | 9/1959 | Moncrieff-Yeates | 430/31 |
| 2,937,943 | 5/1960 | Walkup | 430/55 |
| 3,322,539 | 5/1967 | Redington | 430/55 |
| 3,502,408 | 3/1970 | Brodie | 430/48 |
| 3,598,579 | 8/1971 | Robinson | 430/48 |

FOREIGN PATENT DOCUMENTS

| | | | |
|---|---|---|---|
| 4953044 | 5/1974 | Japan | 430/55 |
| 51-122450 | 10/1976 | Japan | 430/55 |

*Primary Examiner*—John D. Welsh
*Assistant Examiner*—John L. Goodrow
*Attorney, Agent, or Firm*—Wolder, Gross & Yavner

[57] ABSTRACT

An electrophotographic copying method in which there are employed a photosensitive member including a photoconductor layer backed by a conductive electrode and a dielectric layer backed by a conductive electrode comprises the steps of positioning the members with the layers in face-to-face virtual contact and while so positioned applying a voltage of a first polarity between the electrodes under dark conditions to cause gaseous discharges in the gaps between the layers and the charging of the dielectric layer and short circuiting the electrodes while illuminating the photoconductive layer until the electric field therein is zero, and then applying a voltage of reverse polarity between the electrodes while exposing the photoconducted layer to a light image to produce an electrostatic latent image thereof on the dielectric layer which is then separated from the photoconductor layer and the latent image developed and transferred to copy paper. Follower transfer of the developed image the dielectric layer is cleaned of residual toner and residual charges are removed by repositioning the dielectric layer in virtual contact with the photoconductor layer and alternately applying voltages of opposite polarities between the electrodes while illuminating the photoconductor layer. Equations setting forth the values of the applied voltages are given.

11 Claims, 18 Drawing Figures

Transfer Potential (volts)
-50
-40
-30
-20
-10
0
0.1
1
10
100
1000
Illumination Intensity(lux)

Applied Time(sec)
Transfer Potential (volts)
50
0.01
0.1
1.0
0
-100
-200

Applied Time(sec)
Transfer Potential (volts)
50
0.01
0.1
1.0
0
-100
-200

ELECTROPHOTOGRAPHIC IMAGE FORMING METHOD

BACKGROUND OF THE INVENTION

The present invention relates to improvements in electrophotographic image forming methods and it relates more particularly to an improved method for forming an image of high contrast and free of fog by the simultaneous charge transfer process while permitting the repeated use of the electrostatic charge receiving dielectric member.

A simultaneous charge transfer method is described in U.S. Pat. No. 2,825,814 issued Mar. 4, 1958 and employs a photosensitive member including a photoconductive layer on a light transparent electrode plate (normally a NESA treated glass plate) and an electrostatic charge receiving dielectric member in the form of a flexible belt including a layer of a few microns thickness of a highly insulative dielectric material formed on a flexible electrode. The surface of the photoconductive layer of the photosensitive member is firmly held in face-to-face contact with the surface of the dielectric layer of the belt and then a direct current voltage of 500 to 1000 volts is applied between the light transparent electrode plate of the photosensitive member and the flexible electrode of the dielectric belt simultaneously with the exposure of the back of photosensitive member to a light image so as to form an electrostatic latent image of the light image on the surface of dielectric layer. Further, the use instead of the dielectric belt of electrostatic transfer paper in which a dielectric layer of high resistivity is coated onto an electroconductive layer of high resistivity is described in U.S. Pat. No. 3,502,408 issued Mar. 24, 1970.

Among the advantages or features of the aforesaid simultaneous charge transfer process are that a positive latent image can be formed from a negative original, that an electrostatic latent image can be formed in a short period of time without requiring a large number of steps, and that a high voltage source in the order of a couple of thousand volts, such as for corona discharge device, is not required. On the other hand, there is the disadvantage that the transfer efficiency at an air gap of less than $5\mu$ or over $40\mu$ between the photoconductive layer and the charge receiving dielectric layer markedly deteriorates and as a consequence when the normal techniques are utilized to effect the face-to-face contact between the photosensitive member and the dielectric member there results in heavy blurs in the image density of the final image. To avoid this, the value of the voltage applied may be increased so that the photosensitivity rises to reduce blurs in image density. However, such expedient causes the non-illuminated areas (i.e., portions on the surface of the dielectric member corresponding to non-exposed areas of the photosensitive member which in turn corresponds to dark portions of the original) to become charged thereby fogging the final copy.

There are various methods proposed to solve the above drawbacks. A first method is to maintain a uniform air gap between the photosensitive member and dielectric member by positioning number of plastic balls of few microns in diameter therebetween in a scattered arrangement in the manner described in U.S. Pat. No. 2,825,814. A second method is to apply a biasing voltage to the developing electrode at the time of development so as to lower the fog density of the image as described in Japanese Laid Open Patent Application No. 51-122450. A third method is to precharge the dielectric member prior to the image forming step, as described in U.S. Pat. No. 2,937,943 issued May 24, 1960, by applying a voltage of a polarity opposite to that of the voltage to be applied at the time of exposure to a light image simultaneously with the full illumination to light, and a fourth method as described in Japanese Patent Publication No. SHO 51-29019 is to apply a voltage of opposite polarity under conditions of darkness after the formation of the latent image so as to reduce the fogging of the image.

However, each of the above methods possesses disadvantages. In the first method the photoconductive layer as well as the dielectric layer are subject to damage by the plastic balls and handling of these plastic balls are difficult and inconvenient; in the second method, a mechanism is required for applying a biasing voltage to the developing electrode and such electrode is easily soiled; in the third method, the intensity of the illumination of the photosensitive member must be highly uniform in order to uniformly charge the dielectric member and the applied voltage, the intensity of the illumination and the amount of time the voltage is applied must be accurately controlled and maintained in order to always charge the dielectric member to a constant surface potential; and in the fourth method, fogging is not completely prevented but still remains to an undesirable degree and additionally, the step of applying the voltage in the dark cannot be conducted until there is absolutely no influence from the light used to expose the original.

Aside from these disadvantages, where the electrostatic charge receiving dielectric member is to be repeatedly used with a latent image being formed on the dielectric member by the simultaneous charge transfer process and this image being then developed and subsequently transferred onto a copy paper, there is the need after the cleaning of the residual toner to erase any residual charge from the dielectric member in order that the same may be repeatedly used. Conventional methods for the removal of residual charges involve the use of an A.C. corona discharger as described in U.S. Pat. No. 2,777,957 or the use of a metal roller carrying a biasing voltage in which the roller is brought into contact with the surface on which the residual charges are present as described in Japanese Laid Open Patent Application No. SHO 49-53044. However, each of these methods require special devices and the control of their operation is highly complicated.

Additionally, if there is employed an image forming method wherein the dielectric member is precharged to a polarity opposite to the polarity of the latent image and a voltage is then applied simultaneously with the exposure to the light image, there will be charges of both positive and negative polarities remaining on the dielectric member and the erasure thereof is more complicated than the case of only single polarity.

SUMMARY OF THE INVENTION

It is accordingly a primary object of the present invention to provide a novel and improved electrophotographic image forming method.

Another object of the present invention is to provide an electrophotographic image forming method of the simultaneous charge transfer type which produces an image of high contrast and free of fog.

Still another object of the present invention is to provide an electrophotographic image forming method of simultaneous charge transfer type which continuously produces copies and allows the repetitive use of the electrostatic charge receiving dielectric member.

Still another object of the present invention is to provide an improved method for producing copies by utilizing a simultaneous charge transfer technique in which a dielectric member is repeatedly used by subjecting it to an erasing step.

The above and other objects of the present invention are achieved by the electrophotographic image forming method in accordance with the present invention in which an electrostatic charge receiving dielectric member is held in face-to-face virtual contact with a photosensitive member and comprises the image forming steps including a first step of applying a direct current voltage to the air gap between the photosensitive member and the dielectric member under dark or unilluminated conditions with the applied voltage being of sufficient value to cause air breakdown discharges in the air gap even under dark conditions; a second step of short-circuiting the photosensitive and dielectric members and exposing or illuminating the photosensitive member until the electric field therein becomes substantially zero; a third step of applying voltage simultaneously with the exposure of the photosensitive member to a light image; and a residual charge erasing step which includes alternately applying voltages of respectively positive and negative polarity between the photosensitive member and dielectric member simultaneously with the illumination or exposure of the photosensitive member.

For a fuller understanding of the nature and objects of the present invention, reference is made to the following detailed description taken in conjunction with the accompanying drawings.

Figure 2A:
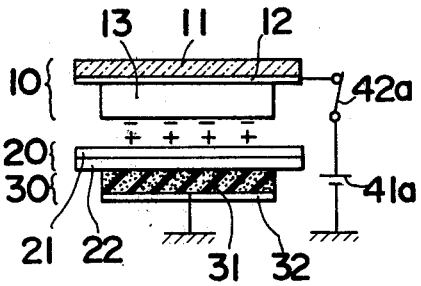
Figure 2B:
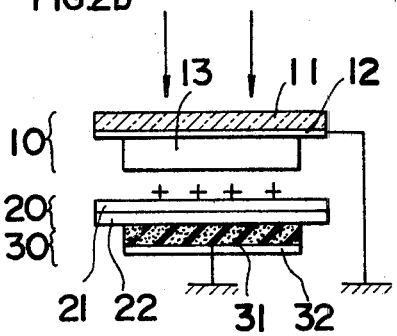
Figure 2C:
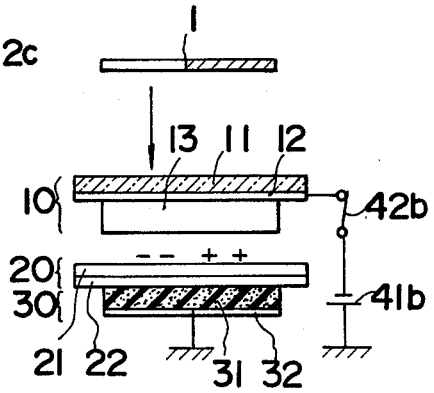
Figure 3:
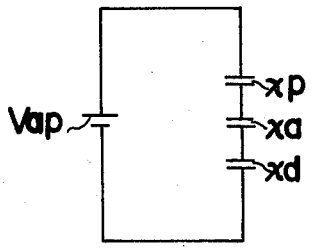
Figure 4:
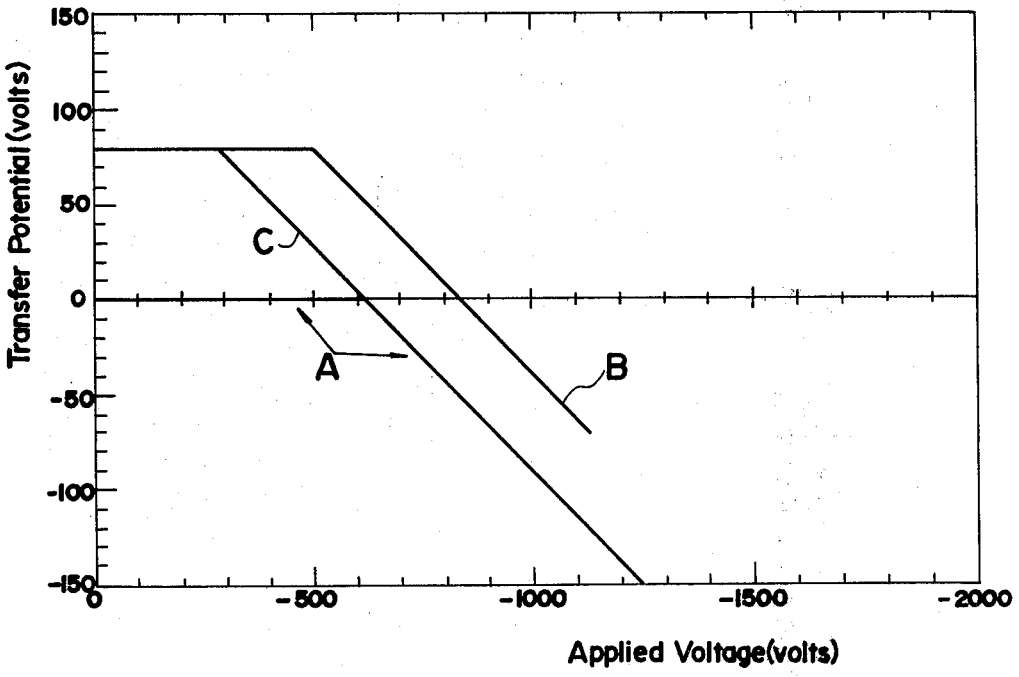
Figure 5:
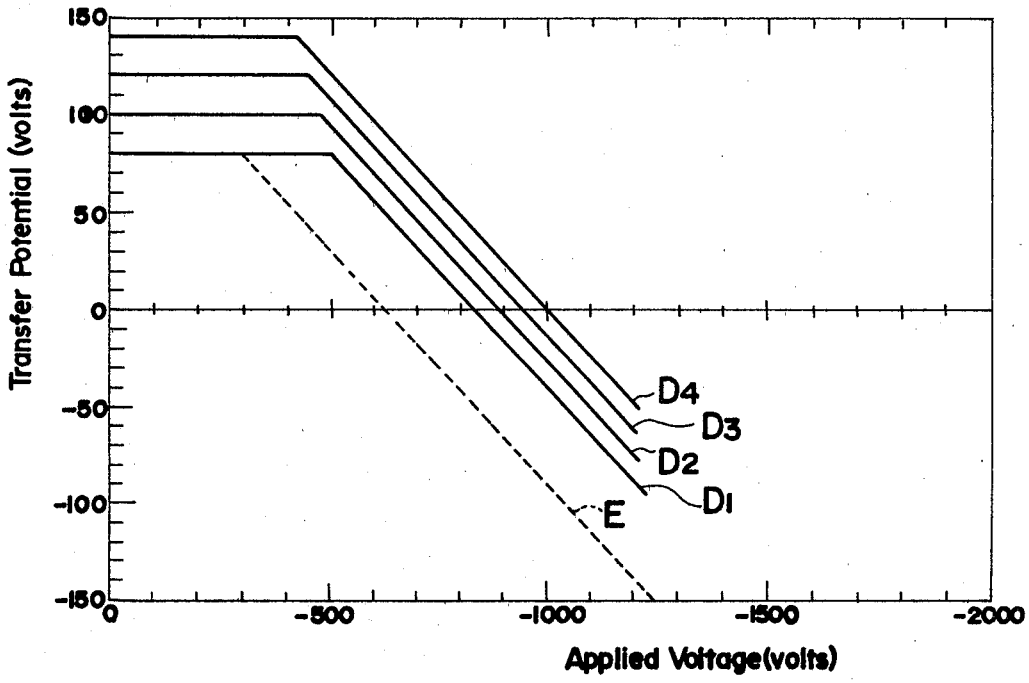
Figure 6:
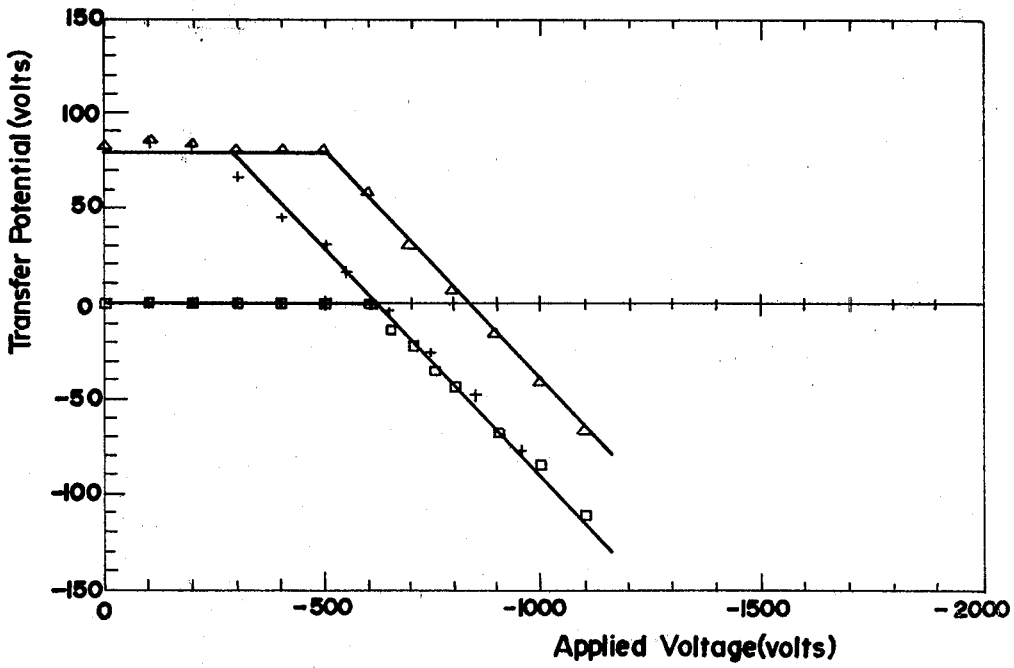
Figure 7:
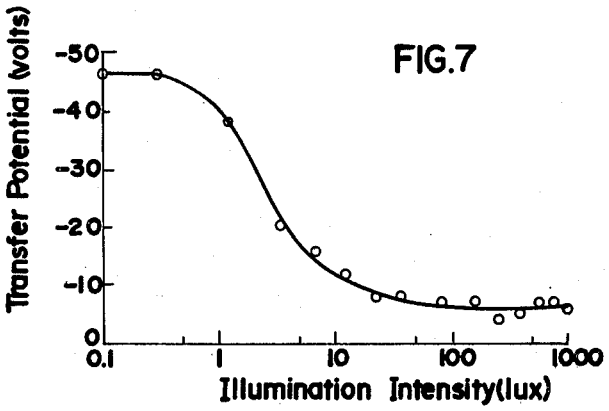
Figure 12A:
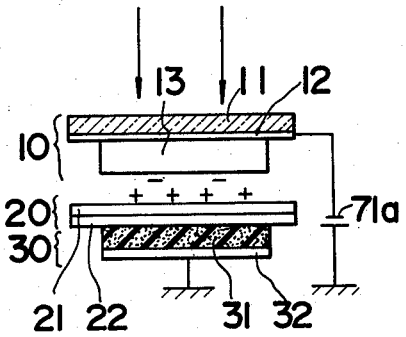
Figure 12B:
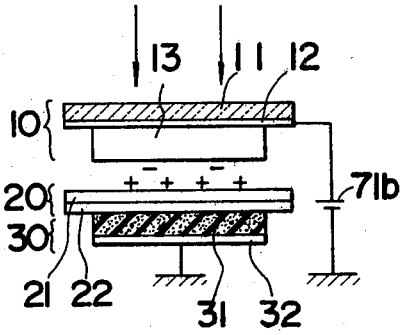
Figure 13:
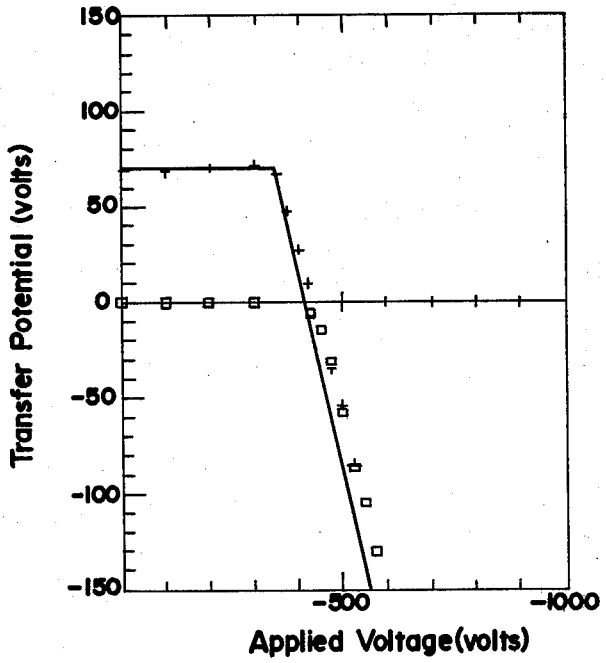
Figure 14:
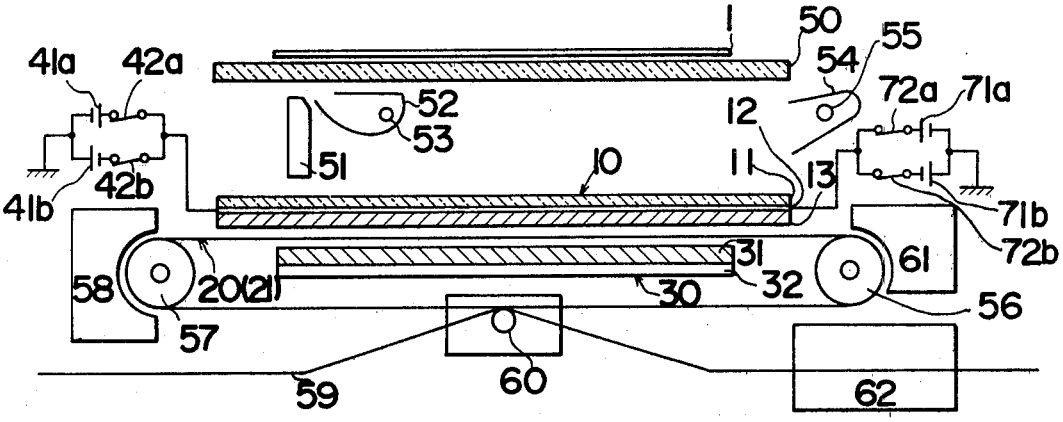
Figure 15:
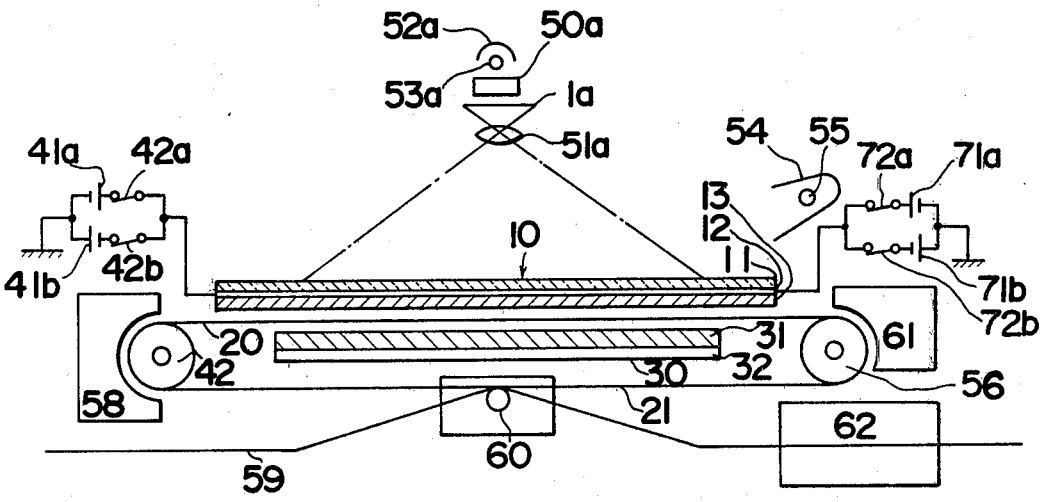

FIGS. *2a* through *2c* are diagrammatic views illustrating electrostatic latent image forming mechanisms performing first, second and third steps of the method according to the present invention;

FIG. 3 is an equivalent circuit diagram corresponding to the electrostatic latent image forming mechanism shown in FIG. 2;

FIGS. 4 and 5 are graphs showing the theoretical quantitative differences in the transferred potential characteristics of the unilluminated areas between the conventional method and the present method;

FIG. 6 is a graph showing the experimental quantitative differences in the transferred potential characteristics of unilluminated areas between the conventional method and the present method;

FIG. 7 is a graph showing the relation between the transfer potentials and exposure illumination intensities;

FIGS. 8 to 11 are graphs showing the relation between transfer potentials and the applied voltage durations;

FIGS. 12*a* and 12*b* are diagrammatic views illustrating the steps of erasing residual charges in accordance with the present invention;

FIG. 13 is a graph showing the relation between the residual transfer potentials and the applied voltages;

FIG. 14 is a diagrammatic view of a copying apparatus employing the method of present invention and particularly suited for producing positive images from positive originals; and FIG. 15 is a diagrammatic view of another copying apparatus employing the method of the present invention and particularly suited for producing positive images from an original negative film.

DESCRIPTION OF THE PREFERRED EMBODIMENTS

Figure 1:
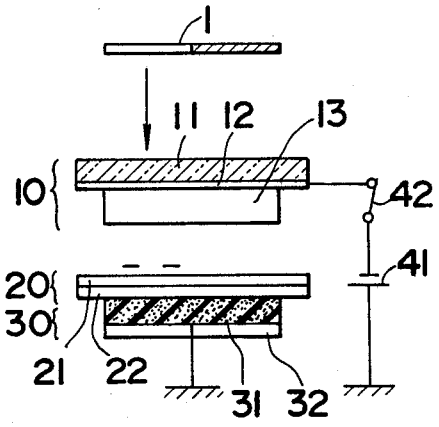
FIG.1 PRIOR ART
FIG. 1 is a diagrammatic view of a conventional electrostatic latent image forming mechanism employing the simultaneous charge transfer process.

Referring now to FIG. 1 in which there is shown an electrostatic latent image forming mechanism employing the simultaneous charge transfer process described in U.S. Pat. Nos. 2,825,814 and 3,502,408, reference numeral 10 generally designates an electrophotographic sensitive member in the form of a plate or sheet which is held in uniform face-to-face or facewise contact with an electrostatic charge receiving dielectric member 20 (these are shown as remote from each other in the drawings for convenience of illustration). The photosensitive member 10 includes a light transparent glass base 11, an electrode plate 12 of a light transparent, electroconductive material such as NESA glass (registered trademark) on said base and a photoconductive layer 13 superimposed thereon. The dielectric member 20 includes a dielectric layer 21 coated on an electroconductive layer 22. It will be noted that the dielectric member 20 may be an electrostatic transfer paper having a dielectric layer coated on an electroconductively treated base paper or may be in the form of an endless flexible belt for repetitive use.

It is believed that even in the situation where the dielectric member and the photosensitive member are held in intimate confronting or face-to-face contact with each other, there exists an air gap of about 5 to 15 microns in average between the confronting faces of the two members due to their respective surface roughness, in the non-uniformity in holding them in even contact and for other reasons. Thus, the confronting contact between the photosensitive member and the dielectric member will be referred to hereinafter as "virtual contact".

The numeral 30 designates a pressure member consisting of a pressing plate 32 and electroconductive elastic pad 31 of sponge foam or the like for effecting the virtual contact between the face of the dielectric layer of dielectric member 20 and the face of the photoconductive layer 13 of photosensitive member 10. The photosensitive member 10, specifically the electrode plate 12, is electrically connected to a direct current voltage source 41 through a normally open switch 42 and the dielectric member 20, specifically the conductive member 22 is electrically grounded through the pressure member 30. An original 1 to be copied is placed on a suitable support (not shown) over the photosensitive member 10 with the image thereof exposed by a light source (not shown) and projected by a suitable optical system (not shown) through plate 11 and electrode 12 onto the rear face of photoconductor layer 13. To form an electrostatic latent image on the dielectric member, the photosensitive member 10 and the dielectric member 20 are brought into virtual contact and the switch 42 is then closed to apply a direct current voltage of, for example, about 500 to 1000 volts between the electrode plate 12 and the electroconductive elastic pad 31 from the voltage source 41 and simultaneously with this, the light image of original 1 is exposed and projected onto the rear face of the photosensitive member. An electrostatic latent image is thus formed on the dielectric member so that the same may be developed to obtain a positive copy from a negative original.

This simultaneous charge transfer process for forming an electrostatic latent image is generally explained as follows: The application of a voltage to the photosensitive member simultaneously with the projection thereon of a light image of an original causes holes and electrons to be generated in the light illuminated areas within the photoconductive layer 13 thereby causing conductivity or polarization in the corresponding portions of the photoconductive layer 13. As a consequence, the potential difference in the air gap between the dielectric member 20 confronting the light illuminated portions of the photoconductive layer 13 rises and when this difference exeeds the discharge initiating voltage as determined by Paschen Law, air breakdown discharges occur and electrons or ions generated thereby are transferred onto the dielectric member 20. Thus, there is formed an electrostatic latent image on the dielectric member with charges on the portions thereof corresponding to the light illuminated portions of the photoconductive layer.

To obtain an image of high contrast and free of fog by the afore-described simultaneous charge transfer process, resort to the following measures may be considered: To obtain an image of high contrast, it is desirable to set the voltage applied between the photosensitive member and dielectric member to a high value. On the other hand, it is desirable in order to obtain an image free of fog to set the voltage at a low enough value insufficient to cause air breakdown discharges in the air gap corresponding to unilluminated portions of the photoconductive layer. Accordingly, it has been a general practice to set the level or value of the voltage to about 100 volts less than that required to cause air breakdown discharges in the air gap of non-illuminated portions in order to obtain an image of high contrast and free of fog. However, such a low amount of applied voltage causes blurs in the transfer of charges due to the non-uniformity in the air gap and in consequence, blurs or unevennesses in the image density occurs, particularly in the low density image portions.

From the above, one might consider as a solution to precharge the entire surface of the dielectric member to a polarity opposite to that of the electrostatic latent image and to thereafter apply a voltage between the photosensitive member and dielectric member simultaneously with the exposure of the photosensitive member to a light image. Such a method is described in U.S. Pat. No. 2,973,943 in which the surface of the dielectric member is precharged by applying a voltage at a polarity of which is opposite to the polarity of the voltage applied in the succeeding step in which the voltage is applied simultaneously with exposure to an image simultaneously with the full surface illumination of the photosensitive member. However, the drawbacks with this method are that the intensity of the light reaching the photosensitive member must be uniform in order to uniformly charge the entire surface of the dielectric member and additionally, the voltage to be applied, the time during which voltage is applied and the light intensity must be accurately adjusted and maintained in order to always charge the dielectric member to a constant surface potential.

In accordance with the method of the present invention which includes electrostatic latent image forming steps, the above described drawbacks are solved and overcome, and this will be hereinafter explained with references made to FIGS. 2*a* and 2*c*.

The method for forming an electrostatic latent image in accordance with the present invention basically comprises three steps and as shown in FIG. 2*a*, the first step is to apply a direct current voltage between the photosensitive member 10 and the dielectric member 20 under unilluminated or dark conditions with the applied voltage being of sufficient value to cause air breakdown discharges in the air gap between the photosensitive member 10 and the dielectric member 20 even under dark conditions with the photoconductor layer 13 being unilluminated. Specifically, the first step is to apply under dark conditions a voltage from voltage source 41*a* through the closed switch 42*a* to the NESA treated electrode plate 12 with such voltage being of a sufficiently high value to cause air breakdown discharges in the air gap between the photosensitive member 10 and the dielectric member 20. The duration of the applied voltage may be as long as the output of source 41*a* permits, provided that it is a sufficiently short period of time (for example, less than 0.1 to 0.01 second) so that the dark resistivity of the photoconductive layer 13 can be substantially neglected.

By the first step, the full surface of dielectric layer 21 of charge receiving dielectric member 20 is charged with charges of a polarity the same as that of the applied voltage from source 41*a*. On the other hand, the surface of the photoconductive layer 13 is charged to polarity opposite to that of the applied voltage. The uniform charging on the surface of dielectric member 20 is effected because the applied voltage is sufficiently high to cause air breakdown discharges in the air gap even in the dark condition.

To derive an equation representing for determining the potential of dielectric member 20 charged by the first step, reference will first be made to FIG. 3 which shows an equivalent circuit corresponding to the simultaneous charge transfer mechanism shown in FIG. 2. In this figure, $\chi p$, $\chi a$ and $\chi d$ respectively represents the air gap equivalent thicknesses in unit microns of photoconductive layer 13, the air gap between the photosensitive member and the dielectric member and of the dielectric member itself. Here, the air gap equivalent thickness is obtained by assuming that the photoconductive layer 13, the air gap and the dielectric layer 21 respectively as dielectrics and the thicknesses of these dielectrics are each divided by their relative dielectric constants. Additionally, the electrostatic capacity (in units of $pF/cm^2$) of the respective dielectrics are in the relation of $C\text{-}885/\chi$. Also Vap in FIG. 3 represents applied voltage.

From the afore-described equivalent circuit, the following equation is derived:

$$Vap = \frac{qt}{\epsilon o}(\chi p + \chi d) + \frac{q}{\epsilon o}(\chi p + \chi d + \chi a) \qquad a$$

$$Vb\,(\chi a) = Vao + \chi aq/\epsilon o \qquad b$$

Here, Vb ($\chi$a) is the air breakdown discharge initiating voltage in accordance with Paschen Law and that with $\chi$a, it is in the relation of $312+6.2\,\chi a$. As to $\epsilon o$, it represents the dielectric constant, qt the amount of charges transferred onto the dielectric member, q the amount of charges induced on the photoconductive layer, air gap and dielectric member and Vao the potential in the air gap prior to the application of the voltage. From equations a and b, $$qt = \frac{\epsilon o}{\chi p + \chi d}\left\{ Vap - \frac{\chi p + \chi d + \chi a}{\chi a}(Vb(\chi a) - Vao) \right\} \quad c$$

Accordingly, the surface potential $V_T$ of the dielectric member 20 charged by the first step is:

$$V_T = \frac{\chi d}{\epsilon o}(qto + qt) \quad d$$

$$= Vto + \frac{\chi d}{\chi p + \chi d}\left\{ Vap - \frac{\chi p + \chi d + \chi a}{\chi a}(Vb(\chi a) - Vao) \right\}$$

Here, Vto is the initial surface potential of the dielectric member and qto is the initial surface charge density thereof. Since Vao and Vto are respectively zero, $V_T$ at the termination of first step becomes as follows:

$$V_T = \frac{\chi d}{\chi p + \chi d}\left\{ Vap - \frac{\chi p + \chi d + \chi a}{\chi a} Vb(\chi a) \right\} \quad (I)$$

From this equation I, it can be seen that in order to charge the surface of dielectric member with some potential, the applied voltage Vap should be at least of a value such that the product of $\chi d/(\chi p+\chi d)$ and Vap is greater than the product of $\chi d/(\chi p+\chi d)$ and $\{(\chi p+\chi d+\chi a)/\chi a\}Vb(\chi a)$.

The second step according to the present invention follows the first step and includes the short circuiting of electrode plate 12 and electroconductive sponge pad 31 while fully illuminating the photoconductive layer until the electric field within the photoconductive layer 13 becomes substantially zero as shown in FIG. 2*b*. This illumination may be effected from rear of the photosensitive member 10 in such a manner that the light reaches the photoconductive layer 13 to light excite it so as to generate charge carriers therein. By this, expedient charges on the photoconductive layer 13 are neutralized with the electric field in the photoconductor layer and brought to zero. There are no adverse effects even if the amount of illumination is excessive, or even if the illumination is uneven as long as the illumination is effected in an amount sufficient to cause the electric field within the photoconductive layer to become substantially zero.

The third step according to the present invention is to expose the photosensitive member to a light image simultaneously with the application of a voltage between the photosensitive and dielectric members, as shown in FIG. 2*c*. Specifically, in the third step, an original 1 (a negative image) is exposed and an image thereof projected on the rear of photoconductive layer 13 exposed and simultaneous therewith a voltage is applied between the members at a polarity opposite to that of the voltage applied in the first step. By this, holes and electrons are generated in the light illuminated areas within the photoconductive layer 13 thereby causing polarization and as the result, air breakdown discharges occur in the air gap between the photoconductive and dielectric layers. With the air breakdown discharges, charges on the dielectric member 20 confronting the light illuminated areas are neutralized and charges are transferred thereon. Accordingly, if the polarity of the applied voltage in the first step is positive and negative in the third step, then there will be transferred on the dielectric member with respect to negative original 1 negative charges on the image areas (illuminated areas) and positive charges on the non-image areas (non-illuminated areas). However, there occurs in practice air breakdown discharges in the air gap corresponding to unilluminated areas in this third step as in the first step. To determine the transferred surface potential $V_T$ on the dielectric member 20 at this time, i.e., the surface potential $V_T$ of unilluminated areas on the dielectric member 20 at the termination of the third step, the following relationship applies:

$$Vao = \frac{-\chi a}{\chi a + \chi d} Vto \quad e$$

From equations d and e, the following is derived.

$$V_T = Vto + \frac{\chi d}{\chi p + \chi d}\left\{ Vap - \frac{\chi p + \chi d + \chi a}{\chi a}\left(Vb(\chi a) + \frac{\chi a}{\chi a + \chi d} Vto\right) \right\} \quad (II)$$

In this equation II, Vto should be regarded as $V_T$ of equation I. As will further become apparent from the description hereinbelow, the maximum allowable value of applied voltage Vap in the third step without causing fog is when $V_T$ of equation II becomes zero.

While the foregoing relates to the first to third steps, the equation for surface potential $V_T$ of unilluminated areas on the dielectric member 20 at the termination of the third step without conducting the second step (i.e., the amount of illumination being zero) will be shown for comparison purpose.

$$V_T = Vto + \frac{\chi d}{\chi p + \chi d}\left\{ Vap - \frac{\chi p + \chi d + \chi a}{\chi a}\left(Vb(\chi a) + \frac{\chi a(\chi p + \chi d)}{\chi d(\chi p + \chi d + \chi a)} Vto\right) \right\} \quad (III)$$

Reference is now made to the transfer potential characteristic curves shown in FIG. 4 to explain the quantitative differences between the method according to the present invention and conventional method. In FIG. 4, the vertical axis designates the transferred surface potential of the unilluminated areas on the dielectric member at the termination of the step wherein the photosensitive member is exposed to a light image simultaneously with the application of a voltage and the horizontal axis designates the applied voltage at the time of such exposure. It will be noted that the averages of $\chi p$, $\chi d$ and $\chi a$ were respectively determined as 3.8, 1.2 and 6.5 and that the polarity of the applied voltage was negative.

According to the conventional method wherein the dielectric member is not precharged, but rather an electrostatic latent image is formed by the step shown in FIG. 1, the applied voltage Vap is determined by theoretical curve A calculated in accordance with equation I. It should be noted that the reason why equation I which was described in connection with the first step of the present invention can be applied to the conventional method is because air breakdown discharges occur in the dark in both methods. From curve A, it can be seen that the absolute value of the applied voltage must be less than 620 volts in order to obtain a copy without background fog only by the step shown in FIG. 1. In other words, the air breakdown discharges will occur in the air gap of the unilluminated areas if the applied voltage is set at a value greater than −620 volts thereby causing charges to be transferred onto the background area of the dielectric member which appear as fog when developed.

In the steps shown in FIGS. 2*a* to 2*c* and in the case wherein the second step was omitted and the third step was followed by the first step, then the theoretical curve C calculated by equation III was drawn. Here, the potential $V_T$ transferred onto the surface of the dielectric member by the application of a voltage in the first step was assumed to be 80 volts. It should be observed in curve C that the transferred potential on the dielectric member perfectly coincides with curve A in the negative region. This indicates that the method without the second step requires that the absolute value of the applied voltage be less than 620 volts as with the aforesaid conventional method indicating that no improvement is achieved.

On the contrary, the transfer characteristic in accordance with the method of the present invention becomes the theoretical curve B(transferred surface potential $V_T$ being assumed to be 80 volts). From this result, it is observed that a copy of high contrast and free of fog in the background areas can be obtained even if the absolute value of the applied voltage is increased to 830 volts. Thus, the applied voltage may be further increased by increasing the transferred surface potential onto the dielectric member in the first step.

While the above description has been made to obtain a positive copy from a negative original (i.e., negative film), the method of the present invention is applicable in obtaining a positive copy from a positive original. In this case, the illuminated areas and the unilluminated areas in the above description will merely be opposite, that is, the illuminated areas will be non-image portions where as the unilluminated areas will be image portions with respect to the positive original.

To be more specific, the equation II can be applied to positive to positive copying and this will be explained by the transferred potential characteristic curves shown in FIG. 5. In calculation, $\chi p$, $\chi d$ and $\chi a$ were assumed to be the same as the case of FIG. 4. In FIG. 5, D1, D2, D3 and D4 are curves representing the theoretical transfer characteristics in accordance with the method of the present invention and which were derived from equation II with the transferred potential charged by the first step being 80 volts, 100 volts, 120 volts and 140 volts for the respective curves D1, D2, D3 and D4. On the other hand, the curve E designates the theoretical transfer characteristics calculated from equation III in which the second step was omitted. Comparing the curves D1 and E where precharged potential is 80 volts, the maximum voltage Vap which can be applied in the third step is −830 volts for the former and only −620 volts for the latter. Additionally, if the voltage applied in the third step was set to −500 volts, then the transferred potential of the dark areas (unilluminated areas) according to theoretical curve E would be 30 volts whereas it would be 80 volts for curve D1. This demonstrates that a high contrast image is obtained by the method in accordance with the present invention. Furthermore, the same conclusions may be drawn for theoretical curves D2, D3 and D4 wherein the maximum allowable voltage to be applied in the third step is about −880 volts, −940 volts and −1000 volts respectively. Accordingly, an image of high contrast without fogging can be formed by suitably setting the value of the applied voltage in the third step.

As far as the development of the electrostatic latent image after the third step, any developer may be used. For example, the latent may be developed by a toner having a polarity opposite to the latent image or by a mono-component toner. In the case where the mono-component toner is used, the potential of the unilluminated areas should be sufficiently low compared to potential of illuminated areas.

EXAMPLE 1

The photosensitive member 10 was prepared by forming a photoconductive layer 13 of about 30 microns thick on an electroconductive layer 12 which in turn was formed by the NESA treatment of the surface of a glass plate of 5 mm thickness. The photoconductive material used was a photoconductive powder of Cds:nCdCO3 ($0.8 \leqq n \leqq 1$) which together with a metallic activator is dispersed in an acryl binder resin. The capacitive air gap equivalent thickness $\chi p$ of this photoconductive layer 13 was determined to be 3.8. As the dielectric member 20, an electrostatic transfer paper with a dielectric layer 21 coated over an electroconductively treated base paper 22 manufactured by Crown Zellerbach Co. was used. Its capacitive air gap equivalent thickness $\chi d$ was 1.2. As to $\chi a$, the average value was determined to be 6.5. A negative image microfilm was used as the original to be copied.

The photosensitive member 10 and transfer paper 20 were brought into virtual contact with one another in the manner shown in FIG. 1 and then voltage was applied to the electroconductive layer 12 with the value thereof varied stepwise in the range of 0 to −1100 volts while the photosensitive member was exposed to an image in order to observe the transferred potential characteristic onto the paper 20. The duration of each of the step applied voltages was about 0.1 second. The measured results are plotted in FIG. 6 by square marks. It can be seen from the resulting plot that the maximum allowable applied voltage without causing fogging is about −600 volts and the transferred potential characteristic curve drawn thereby substantially follows the theoretical curve A shown in FIG. 4.

Thereafter, the transfer characteristics according to the method of the present invention was measured. This was conducted, with the photosensitive member 10 and transfer paper 20 held in virtual contact with each other, by applying a direct current voltage of 910 volts under dark conditions to the electroconductive layer 12 to uniformly charge the surface of paper 20 (this step corresponds to the first step), and then by electrically grounding both the photosensitive member 10 and the transfer paper 20 to thereby short circuit these, full surface illumination of the rear of photosensitive member 10 is effected at an exposure amount of 970 lux×0.5 second to bring the electric field within the photoconductive layer 13 to substantially zero (this step corresponds to the second step), and finally applying a direct current voltage to the electroconductive layer simultaneously with the exposure thereof to a light image (this step corresponds to the third step). Each of these steps was repeated with the amount of applied voltage varied stepwise from 0 to −1100 volts. The measured transfer potentials were plotted by triangular marks as shown in FIG. 6. From this, it can be seen that the surface of the transfer paper is charged to a surface potential of about 80 volts and that when the amount of voltage applied in the third step exceeds −500 volts, the transfer of charges in the air gap corresponding to unilluminated areas begins to occur thereby neutralizing charges previously deposited. And only when the applied voltage in the third step exceeds about −800 volts, are charges completely neutralized and air breakdown discharges in the air gap of unilluminated areas occur to transfer charges of negative polarity onto the transfer paper which becomes the cause of fogging. Thus, the maximum allowable applied voltage without causing fog is increased to as much as about −800 volts and the experimental characteristic curve thereof is substantially the same as the theoretical curve B shown in FIG. 4. Accordingly, there is formed a latent image of better contrast on the transfer paper corresponding to light illuminated areas since the amount of voltage applied is increased as compared with the conventional method.

Similar experiments were conducted in accordance with the method of the present invention, but with the second step omitted in order to determine the transfer characteristics. Specifically under the same conditions as above, a voltage of 910 volts was first applied under dark conditions, similar to the first step and immediately following thereafter a voltage was applied simultaneously with the exposure of the photosensitive member to a light image which is the step corresponding to the third step. Each of these steps were repeated with the value of the applied voltage in the latter step varied stepwise. The results of the measured transfer potentials onto the transfer papers corresponding to the unilluminated areas are shown in FIG. 6 by the cross marks. The resulting curve is substantially the same as the theoretical curve C of FIG. 4 and demonstrates that the voltage applied in the third step must be less than about −600 volts in order to form a latent image free of fog. This is no improvement over the conventional method shown in FIG. 1 since it also requires that the applied voltage be less than −600 volts. Thus, it can be concluded that the second step is required in the method of the present invention.

To experimentally determine the amount of exposure necessary for the second step of full surface illumination, the voltage applied to a lamp for the purpose of illumination was adjusted to vary the illumination intensity with the value of the applied voltage in the third step being set to −850 volts. The illumination intensity was varied in the range of about 0.1 to 1000 lux. The relationship between the illumination intensities and the transferred surface potentials of the un-illuminated areas onto the transfer papers is shown in FIG. 7. From this, transfer potentials average out at an illumination intensity of about 100 lux and collating these results with the measured results shown by the triangle and cross marks of FIG. 6, it was confirmed that an image of high contrast and free of fog is obtained with the amount of exposure greater than about 50 lux—second (i.e., 100 lux×0.5 second) in the second step.

EXAMPLE 2

Figure 8:
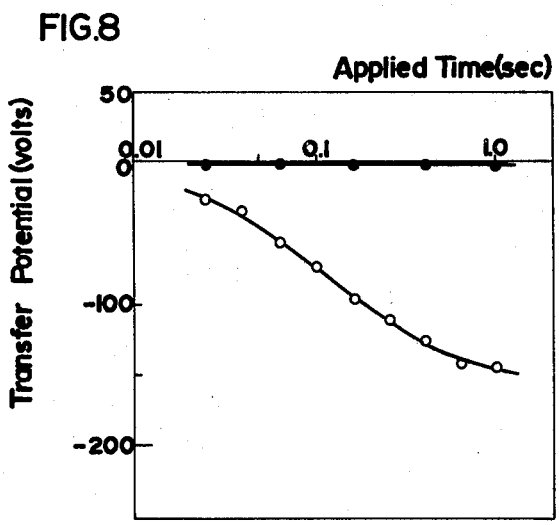
Figure 9:
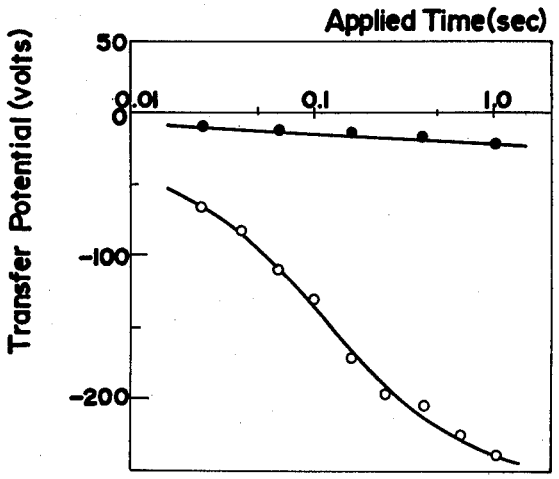
Figure 10:
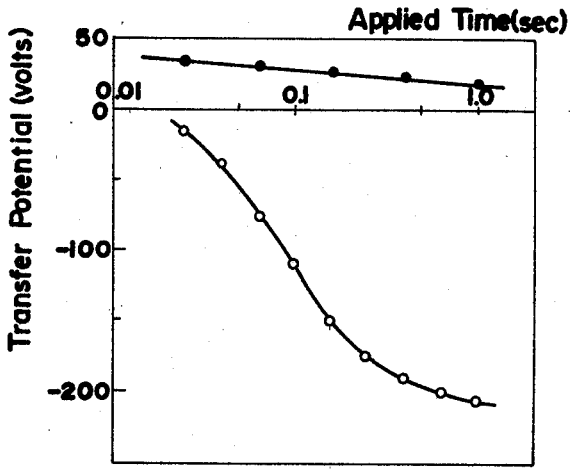

With reference to the experimental results of Example 1, further experiments were conducted to observe images actually formed by conventional method and present method. The same original, photosensitive member and transfer paper as employed in Example 1 were used and the light intensity onto the photosensitive member at the time of exposure to a light image of the original was set to 192 lux. For developing the electrostatic latent image formed on the transfer paper, four pairs of metal rollers each having a diameter of 16 mm and arranged in parallel relation were used. All of these pairs of metal rollers are immersed in a developing liquid and transport the transfer paper at a speed of 10 cm/sec therethrough. As the liquid developer, positively charged toner under the trade name of DIC-05 manufactured by Dainihon Ink Co. was used. Along with the image forming experiments, measurements were made of the relationship between the applied voltage durations and the transferred surface potentials of the illuminated and unilluminated areas on the transfer paper. FIGS. 8 to 10 show these measured results wherein vertical and horizontal axes respectively represent the transferred surface potentials of the transfer paper and the applied voltage durations with the circle marks being the measured potentials of the illuminated areas and the filled circle marks being the measured potentials of unilluminated areas.

In an experiment following the conventional method shown in FIG. 1, the voltage applied to the electrode plate 12 while the photosensitive member is exposed to a light image of the original is set to −550 volts by considering the results of Example 1 shown in FIG. 6 by the square marks since a voltage exceeding −600 volts would cause charges to be transferred onto portions of the transfer paper corresponding to unilluminated areas. The duration of the applied voltage was varied stepwise from 0.04 to 1.0 second to form number of latent images and each of these image bearing transfer papers were developed. As the result, a copy of the highest image density without any fog was obtained at an applied voltage duration of 0.16 second. However, its highest image density was still somewhat low and there were unevennesses in the density of the low density portions. The latent image transfer characteristics shown in FIG. 8 indicate that the transfer potential of the illuminated areas at an exposure amount of 192 lux×0.16 second was measured to be about −100 volts.

The same experiments as above were repeated but with the applied voltage set to −650 volts. As may be assumed from the results of Example 1 shown by the square marks in FIG. 6, charges were transferred at the unilluminated areas regardless of applied voltage duration from 0.4 to 1.0 second as shown by the filled circle marks in FIG. 9. However, the maximum image density is sufficiently high at an applied voltage duration exceeding 0.1 second and the unevennesses in image density in the low density portions were hardly observable although there was heavy fog in the background areas.

Finally, experiments according to the method of present invention were conducted. The applied voltage in the first step was set to +800 volts with the duration at which the voltage was applied being set to 0.1 second. The amount of exposure at full surface illumination in second step was set to 360 lux×0.5 second and the applied voltage in the third step was set to −650 volts. Each of the first to third steps was repeated with the applied voltage duration in the third step varied stepwise from 0.04 to 1.0 second to form a number of latent images on transfer papers. Each of these transfer papers were then developed. No fogging in the background areas was observed on any of the developed images and in particular, the best quality image high in image density and free of fog and yet of no density unevennesses in the low density portions was obtained at an applied voltage of 0.16 second. As shown in FIG. 10, the transfer potential at a light amount of 102 lux×0.16 second was about −150 volts. What should be particularly noted in this figure is that the transfer potentials of the unilluminated areas are all in the positive range at applied voltage durations of 0.04 to 1.0 second as shown by the filled circle marks. Thus, the method of forming a latent image in accordance with the present invention assures formation of copied image of high contrast and free of any fogs.

EXAMPLE 3

Figure 11:
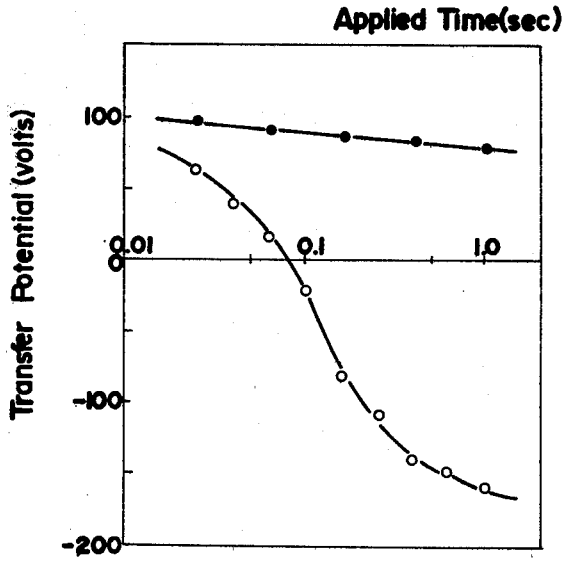

This example deals with experiments in forming positive images from positive image originals. In the first step, voltage of +1200 volts was applied for 0.1 second to the photosensitive member to precharge the transfer paper to a surface potential of about −135 volts. The second step of full surface illumination was conducted at an illumination intensity of 970 lux for about 0.5 seconds. And in the third step, a voltage of −600 volts was applied simultaneously with the exposure of the photosensitive member to a light image of the positive image bearing original at an exposure intensity set to 192 lux. Each of these steps was repeated with the applied voltage duration of the third step varied stepwise from 0.04 to 0.1 second to determine the transferred potentials, the results of which are shown in FIG. 11. With each transfer paper developed by the magnetic brush method using a mono-component toner, it demonstrated that at applied voltage durations of less than 0.1 second charges on the background areas (illuminated areas) were not completely neutralized so that fogging appeared. But at applied voltage durations of 0.1 second, a copy of high contrast and free of fog was obtained with the transferred potentials at unilluminated areas (image portions) being as high as 90 volts and −20 volts at the illuminated areas.

While the above explanation has been primarily directed to the formation of an electrostatic latent image on a dielectric member and the development thereof, it is often desirable to form the final image on plain paper or on other similar materials since a dielectric member in the form of paper is generally more expensive and heavier in weight. In accordance with the present invention, the dielectric member 20 is constructed to be repeatedly employed in a manner that after the formation of a latent image of an original in accordance with the aforesaid first to third steps, the dielectric member 20 is separated from virtual contact with the photosensitive member 10 and then subjected to the development of the latent image. Thereafter, a plain paper or other similar material is brought into contact with the dielectric member 10 thereby transferring the developed image to the paper. The dielectric member is then subjected to the cleaning and erasing of residual toner and charges so as to permit the reuse of the dielectric member. In the erasing of the residual charges, there are normally both positive and negative charges remaining on the dielectric member unless the voltage applied in the third step is of said maximum allowable value causing the potential of the unilluminated areas to become zero. Although the erasing step hereinafter described is applicable to the case of erasing charges of only single polarity, it is normally necessary to erase charges of both positive and negative polarities because the voltage applied in the third step is generally set below said maximum allowable value to make certain that no fogging occurs in the unilluminated areas.

Considering in detail the erasing step in accordance with the present invention with reference to FIGS. 12 and 13, the photosensitive member 10 and dielectric member 20 are brought into virtual contact with one another and then a voltage Vr of positive and negative polarities are alternately applied therebetween for short periods of time while the effecting exposure or illumination of the photosensitive member. The voltage Vr so applied is of such a value that air breakdown discharges occur between the photosensitive member 10 and dielectric member 20 under certain illumination. Specifically, the photosensitive member 10 and dielectric member 20 are brought into virtual contact after the cleaning of the residual toner and as shown in FIG. 12*a*, a voltage from a source 71*a* connected to the NESA electrode plate 12 is set to an applied voltage Vr at a level which causes the transfer of charges therebetween under relatively strong light exposure. With the source voltage set to Vr, full surface illumination of the photosensitive member 10 by a light source (not shown) is simultaneously effected with the application of voltage Vr at a first polarity (e.g., positive polarity) and immediately following, voltage Vr at a second or reverse polarity (e.g., negative polarity) is applied simultaneously with the full surface illumination of the photosensitive member 10 thereby erasing residual charges of both positive and negative polarities from the dielectric member 10. Of course, when there remains charges of only single polarity which occurs in the case of the application of a voltage of the maximum allowable amount in the third step, only a voltage Vr of a polarity opposite to the latent image is applied between the photosensitive member 10 and dielectric member 20 simultaneously with the illumination of the photosensitive member 10.

To determine the value of the voltage Vr of positive and negative polarities which is to be applied in the erasing step, the procedure is in principle the same as the afore-described equation II. Specifically, if the illumination intensity at the time of full surface illumination in the erasing step is sufficiently high so that the resistivity of photoconductive layer 13 can be assumed to be substantially zero, then the transferred surface potential $V_T$ on the dielectric member 20 is represented by the following equation substantially independent of the duration for which the voltage is applied. It should be noted that the dielectric layer 21 is charged to a potential of +Vto, i.e., the residual potential is +Vto and that the voltage applied in the erasing step is at a negative polarity. Thus, the following equation f is only concerned with the voltage Vr to be applied when the residual charges on the dielectric member 20 are of positive polarity. Equation f is the same as equation II and Vr corresponds to Vap and 312+6.2 $\chi a$ corresponds to Vb ($\chi a$).

$$V_T = V_{to} + \left\{ -V_r + \frac{\chi_a + \chi_d}{\chi_a}(312 + 6.2\,\chi_a) + \frac{\chi_a}{\chi_a + \chi_d} V_{to} \right\} \qquad f$$

From this equation, the following is derived:

$$V_T = -Vr + \frac{\chi a + \chi d}{\chi a}(312 + 6.2\,\chi a) \qquad g$$

To make the residual potential of positive polarity on the dielectric member 20 zero, this means that $V_T$ should become zero in equation g. Accordingly, the voltage applied in the erasing step to erase charges of a positive polarity is:

$$-Vr = -\frac{\chi a + \chi d}{\chi a}(312 + 6.2\,\chi a) \qquad \text{(IV)}$$

Thus, the sign of variable in equation IV is merely changed to erase residual charges of a negative polarity.

From the foregoing, it is clear that by the alternate application of voltages Vr and −Vr in accordance with equation IV, while simultaneously effecting the full surface illumination of the photosensitive member, $V_T$ is always reduced to zero value, i.e., the residual charges or potentials are completely erased regardless of the levels of the potentials (Vto, −Vto) of both positive and negative polarities on the dielectric member 20. Similarly, if charges of only one polarity remain, the Vr of an opposite polarity is applied simultaneously with the illumination of the photosensitive member.

It will be noted that the applied voltages Vr and −Vr are not necessarily set to identical values calculated by equation IV, but may be set with a certain degree of freedom. Thus, even if the applied voltages Vr, −Vr are set higher to cause the dielectric member 20 to become charged, no problem is encountered as long as the charged potentials are sufficiently low that the charged surface will not be developed by toner when passing through the developing means.

The erasing step will now be explained by way of example.

EXAMPLE 4

Same photosensitive member as that of Example 1 was used. As for the dielectric member, a dielectric layer of acryl resin formed on an electroconductive sheet was used. The air gap equivalent thicknesses for $\chi p$, $\chi d$ and $\chi a$ were respectively determined to be about 3.8, 1.2 and 6.5.

With the photosensitive member and the dielectric member held in virtual contact with one another, the following experiments were conducted to observe the effects of the erasing step in accordance with the present invention. With no charges on the dielectric layer, i.e., with the surface potential of the dielectric member being zero, full surface illumination from rear of the photosensitive member was effected at an illumination intensity of 960 lux simultaneously with the application of a voltage between the photosensitive member and dielectric member. The applied voltage was varied stepwise with applied voltage duration maintained at 0.1 second. As a result, transfer of charges occurred at applied voltages of about −420 volts as shown by the square marks in FIG. 13. Thus, this apparently indicates that the applied voltage Vr is about −420 volts.

The dielectric member having a surface potential of about +70 volts (i.e., residual potential of +70 volts) is then brought into virtual contact with the photosensitive member and a voltage was applied to effect the transfer of charges while simultaneously illuminating the photosensitive member at an intensity of 970 lux. As can be seen by the cross marks in FIG. 13, the positive charges on the dielectric member were neutralized at an applied voltage of about −420 volts so that the residual potential was reduced to zero. This demonstrates that a residual potential of 70 volts which is the difference between 0 volts and 70 volts was completely erased. In a similar experiment, but with a residual potential of about −70 volts on the dielectric member, the residual charges were completely erased by applying voltage of about +420 volts simultaneously with the full surface illumination of the photosensitive member at an intensity of 970 lux.

It should be noted that solid line shown in FIG. 13 is the theoretical curve following the equation f.

In FIGS. 14 and 15, there are illustrated specific constructions of copying apparatus employing the method in accordance with the present invention. FIG. 14 illustrates a slit or scan exposure type copying apparatus for reproducing a positive image from a positive original 1 in the form of a sheet or book which is placed on a transparent original support plate 50 and thereunder there is positioned as reciprocating movable scanning unit including an image transmitter 51 formed of a bundle of optical fibers of graded refractive index and an image exposure lamp 53 backed by a reflecting member 52. The unit including image transmitter 51 together with the lamp 53 is moved for the scanning of an image along a path parallel to the original 1 and then is returned upon completion of the scan to its original position for the next scanning. Reference is made to U.S. Pat. No. 3,955,888 which describes a mechanism for moving the image transmitter 51 for scanning. In the vicinity of the terminal end of the scanning path of image transmitter 51, there is provided a light source 55 backed by a reflecting member 54 for use in the second and erasing steps of the full surface illumination of the photosensitive member.

The photosensitive member 10 in the form of a plate or sheet, as has been described, comprises a light transparent glass plate 11, a light transparent and electroconductive NESA electrode plate or layer 12 and a photoconductive layer 13 and is disposed parallel to the original plate 50. The NESA electrode plate 12 is connectable to voltage sources 41*a* and 41*b* through normally open switches 42*a* and 42*b*, respectively and also connectable to other voltage sources 71*a* and 71*b*, respectively. Voltage source 41*a* is arranged to supply a voltage of positive polarity in the first step while source 41*b* is to supply a voltage of negative polarity in the third step. Voltage sources 71*a* and 71*b* are for the erasing step and are arranged to alternately supply voltages of positive and negative polarities. As has been explained, the electrode plate 12 is arranged to be electrically grounded in the second step.

The electrostatic charge receiving dielectric member 20 in the form of flexible endless belt rotatably supported by a pair of drive rollers 56, 57 comprises a dielectric layer 21 coated on the outer face of an electroconductive rubber sheet or electroconductively treated Mylar film. As the material for dielectric layer 21, an acryl resin, Mylar film or other similar material may be used and should preferably have a thickness of about 3 to 5 microns. The dielectric member 20 is normally stationary and is pressed against the surface of photoconductive layer 13 by pressure means 30 consisting of an electroconductive sponge pad 31 on a pressing plate 32. It is noted that the dielectric member 20 is electrically grounded through the sponge pad 31 or through rollers 56, 57. As has been described, it is believed that there exists an air gap of about 5 to 15 microns in average between the dielectric member 20 and photosensitive member 10 even if they are in intimate contact due to their surface roughnesses and uneven contact.

Provided along the endless belt dielectric member 20 are a developing means 58 for developing an electrostatic latent image transferring means 60 for transferring the developed image onto a plain copying paper 50 fed thereto and a cleaning means 61 for removing residual toner remaining on the dielectric member. Also in the path of copying paper 59, there is provided a fixing means 62 for fixing the transferred developed image. The developing means employ any known type of developing method such as with the use of a magnetic brush, cascade or even a wet type electrode. Similarly, image transferring means 60 may be a corona discharge device, an electroconductive roller carrying a biasing voltage or any other known means. As for cleaning means 61, a fur brush, elastic blade or other suitable means may be used.

In operation, an original 1 to be copied is placed on the original support plate 50 and then the dielectric member 20 is brought into virtual contact with the photosensitive member 10. Upon actuation of a print switch (not shown), first switch 42*a* is closed to apply a voltage of positive polarity, for example of 1200 volts, between the photosensitive member 10 and the dielectric member 20 from voltage source 41*a* connected to the electrode plate 12. This voltage application is effected under dark conditions with the photosensitive member unilluminated and, air breakdown discharges consequently occur in the air gap to uniformly charge the surface of dielectric member 20. Thereafter, first switch 42*a* is opened and the photosensitive member 10 is electrically grounded and then the light source 55 is energized to effect the full surface illumination of the photosensitive member 10 from the rear thereof until the electric field within the photoconductive layer 13 is reduced to substantially zero. Immediately thereafter, switch 42*b* is closed to apply a voltage of negative polarity between the photosensitive member 10 and the dielectric member 20 from voltage source 41*b*. Simultaneously therewith, the exposure lamp 53 is energized and the image transmitter 51 together with the lamp 53 is moved toward the right parallel to the original plate 50 to scan the image of original 1. As a result, a latent image is formed on the dielectric member 20. The pressure means 30 urging the dielectric member 20 into virtual contact with the surface of photoconductive layer 13 is then released to separate the member 20 from photosensitive member 10. Simultaneously, the rollers 56, 57 are driven to advance the dielectric member 20. As the dielectric member 20 is advanced, the electrostatic latent image formed thereon is developed with toner by developing means 58 and then transferred to a copying paper 59 by image transferring means 60. The paper is thereafter fed to fixing means 62 to become a permanent copy. On the other hand, the advancing dielectric member 20 is subjected to the removal of residual toner by the cleaning means 61 as it passes thereby.

Upon termination of one full rotation of the belt dielectric member 20, the rollers 56 and 57 are deenergized to stop the dielectric member 20. Then the pressure means 30 presses on the rear of dielectric member 20 to bring it into virtual contact with the photosensitive member 10 as a prelude to the step of erasing residual charges of both positive and negative polarities from the dielectric member 20. The erasing step is effected by energizing the light source 55 to fully illuminate the photosensitive member 10 and simultaneously therewith, a voltage of positive polarity is applied to the photosensitive member 10 relative to the dielectric member 20 from voltage source 71*a* by closing switch 72*a* and immediately thereafter, the switch 72*a* is opened and switch 72*b* is momentarily closed to apply a voltage of negative polarity from source 71*b* while continuing the illumination of the photosensitive member by light source 55 so as to erase the positive charges. With the erasing step completed, the next copying operation may be conducted in the manner described above.

The apparatus shown in FIG. 15 is basically the same as that shown in FIG. 14 but adapted to obtain positive image from a negative film original. In the aforesaid apparatus, the original in the form of a film is placed between a condenser lens 50*a* and a projection lens 51*a* and is illuminated and an image thereof projected onto the photosensitive member 10 by an exposure lamp 53*a* backed by reflecting member 52*a*. The copying operation is basically identical to that of the apparatus of FIG. 14 where the same numerals are used to designate similar parts so that a detailed explanation of the operation of the apparatus of FIG. 15 is not necessary and is omitted.

In summary, it can be seen that in accordance with the present invention, (1) the surface potential to which the dielectric member is charged in the first step may always be maintained constant by merely setting the value of the applied voltage; (2) the duration of the applied voltage in the first step may be of any length as long as it is short enough such that the dark resistivity of the photoconductive layer can be substantially neglected; (3) the illumination in the second step is only required to provide an amount of exposure sufficient to reduce the electric field within the photoconductive layer to substantially zero and even or uniform illumination is not necessary; (4) a copy image of fine quality, high in image density, with no unevennesses and free of fog can be obtained; and (5) residual charges of both positive and negative polarities (or only charges of single polarity where this alone is required) are perfectly erased in the erasing step merely setting the applied voltage thereby permitting continued and repeated reuse of the dielectric member. Additionally, there is no need for any special devices such as erasing means and ozone is not generated; and (6) as a whole, high quality images can be continuously obtained by a relatively simple method and yet copying from both positive and negative originals can be continuously and rapidly performed.

While there have been described preferred embodiments of the present invention, it is apparent that numerous alterations, additions and omissions may be made without departing from the spirit thereof.

We claim:

1. An electrophotographic image forming method in which a charge receiving dielectric member is held in virtual contact with a photosensitive member, the method comprising the steps of:

applying a direct current voltage of a first polarity between the photosensitive member and the dielectric member under dark conditions of the photosensitive member of a valve sufficient to cause air breakdown discharges between the members under such dark conditions;

electrically interconnecting the dielectric and photosensitive members and simultaneously illuminating the photosensitive member until the electric field within the photosensitive member becomes substantially zero;

applying a direct current voltage of second polarity opposite to that of the first polarity between the photosensitive member and the dielectric member simultaneously with the exposure of the photosensitive member to a light image of an original; and applying a direct current voltage of said first polarity between the photosensitive member and the dielectric member simultaneously with the illumination of the photosensitive member.

2. An electrophotographic image forming method which comprises the steps of:

virtually face-to-face contacting an electrostatic charge receiving dielectric member with a photosensitive member and applying a direct current voltage of a first polarity therebetween under dark conditions and of a valve sufficient to cause air breakdown discharges between the members under such dark conditions whereby to charge the surface of the dielectric member with charges of first polarity;

short circuiting the photosensitive member and the dielectric member and effecting the illumination of the photosensitive member until the electric field within the photosensitive member becomes substantially zero while said photosensitive member and dielectric member are held in virtual contact;

applying a direct current voltage of a second polarity opposite said first polarity between the photosensitive member and the dielectric member simultaneously with the exposure of said photosensitive member to a light image original while said virtual contact is maintained thereby forming on said dielectric member an electrostatic latent image;

developing the latent image with toner;

transferring the developed image onto a copy member;

cleaning residual toner remaining on the dielectric member; and applying direct current voltages alternately of first and second polarities between the photosensitive member and the dielectric members with said members being in virtual contact simultaneously with the illumination of the photosensitive member thereby erasing residual charges of both first and second polarities remaining on the dielectric member.

3. An electrophotographic image forming method which comprises the steps of:

virtually face-to-face contacting an electrostatic charge receiving dielectric member with a photosensitive member wherein said dielectric member includes a dielectric layer formed of an electrically conductive member and said photosensitive member includes a photoconductive layer on an electrode layer, and applying therebetween under dark conditions a direct current voltage Vap1 of a first polarity and of a value sufficient to cause air breakdown discharges in the air gap therebetween whereby to charge the surface of the dielectric member with charges of first polarity to a surface potential $V_{T1}$ satisfying the equation:

$$VT1 = \frac{\chi d}{\chi p + \chi d}\left\{ Vap1 - \frac{\chi p + \chi d + \chi a}{\chi a} Vb\,(\chi a) \right\}$$

wherein χp, χd and χa are the air gap equivalent thicknesses in microns of said photoconductive layer, dielectric layer and air gap respectively; Vb (χa) being air breakdown discharge initiating voltage in accordance with Paschen Law and in the relationship of 312+6.2 χa with χa; and the voltage Vap1 being such that the product of χd/(χp+χd) and Vap1 is greater than the product of χd/(χp+χd) and {(χp+χd+χa)/χa}Vb (χa);

short circuiting the photosensitive and dielectric members and effecting the full surface illumination of the photosensitive member until the electric field within the photosensitive member becomes substantially zero while said members are held in virtual contact;

applying a direct current voltage Vap2 of second polarity between the photosensitive member and the dielectric member simultaneously with the exposure of the photosensitive member to the light image of an original whereby the surface potential VT2 of the dielectric member at portions corresponding to non-exposed areas satisfies the equation:

$$VT2 = VT1 + \frac{\chi d}{\chi p + \chi d}\left\{ Vap2 - \frac{\chi p + \chi d + \chi a}{\chi a}\left(Vb\,(\chi a) + \frac{\chi a}{\chi a + \chi d} V_{T1}\right) \right\}$$

wherein the maximum value of the voltage Vap2 applied without causing charges of a second polarity to be transferred onto the non-exposed area of the dielectric member is when VT2 in said equation becomes zero; and applying a direct current voltage Vr of the first polarity simultaneously with the illumination of the photosensitive member wherein said voltage satisfies the equation:

$$-Vr = -\frac{\chi a + \chi d}{\chi a}(312 + 6.2\,\chi a)$$

4. The method as claimed in claim 3 wherein said direct current voltage Vr of the second polarity is applied in accordance with the corresponding equation but with the sign of the dependent variable reversed.

5. An electrophotographic image forming method in which an electrostatic charge receiving dielectric member is held in virtual contact with a photosensitive member, the method comprising in sequence;

the first step of applying a direct current voltage Vap1 of a first polarity between the photosensitive member and the dielectric member under dark conditions, said photosensitive member including a photoconductive layer on a light transparent electrically conductive electrode member and said dielectric member including a dielectric layer on an electrically conductive member, said voltage being of sufficiently high value to cause air breakdown discharges in the air gap between the photosensitive and dielectric members whereby to charge the surface of the dielectric member with charges of first polarity to a surface potential VT1 satisfying the equation:

$$VT1 = \frac{\chi d}{\chi p + \chi d}\left\{ Vap1 - \frac{\chi p + \chi d + \chi a}{\chi a} Vb\,(\chi a) \right\}$$

wherein χp, χd and χa are the air gap equivalent thicknesses in microns of said photoconductive layer, dielectric layer and air gap respectively; Vb (χa) is the air breakdown discharge initiating voltage in accordance with Paschen Law and in the relationships of 312+6.2 χa with χa; and Vap1 being such that the product of χd/(χp+χd) and Vap1 is greater than the product of χd/(χp+χd) and {(χp+χd+χa)/χa}Vb (χa);

the second step of short circuiting the photosensitive and dielectric members and effecting the full surface illumination of the photosensitive member until the electric field within the photosensitive member becomes substantially zero while both of said members are held in virtual contact;

the third step of applying a direct current voltage Vap2 of a second polarity opposite to said first polarity between the photosensitive member and the dielectric member simultaneously with the exposure of the photosensitive member to a light image of an original whereby the surface potential VT2 of the dielectric member of portions corresponding to non-exposed areas satisfies the equation:

$$T2 = VT1 + \frac{\chi d}{\chi p + \chi d}\left\{ Vap2 - \frac{\chi p + \chi d + \chi a}{\chi a} (Vb(\chi a) + \frac{\chi a}{\chi a + \chi d} VT1) \right\}$$

wherein the maximum value of the applied voltage Vap2 without causing charges of second polarity to be transferred onto the non-exposed areas of the dielectric member is when VT2 in the equation becomes zero; the fourth step of separating the dielectric member from the photosensitive member and developing the latent image formed on the dielectric member;

the fifth step of transferring the developed image onto a copy paper;

the sixth step of cleaning residual toner on the dielectric member; and the seventh step of alternately applying direct current voltages of first and second polarities between the photosensitive and dielectric members while in virtual contact with each other and while effecting the illumination of the photosensitive member simultaneously therewith, the applied voltage satisfying the equation:

$$-Vr = -\frac{\chi a + \chi d}{\chi a}(312 + 6.2\,\chi a)$$

wherein the variable of the equation is of opposite sign for voltages of first and second polarities.

6. An electrophotographic copying method employing a photosensitive member including a photoconductor layer backed by an electrically conductive electrode and a dielectric layer backed by an electrically conductive electrode, said method comprising:

positioning said members with said layers in face-to-face virtual contact;

while said layers are in virtual contact applying between said electrodes with said photoconductor layer unilluminated a voltage of a first polarity and of a value sufficient to cause gaseous discharges between said layers to change said dielectric layer and thereafter removing said voltage and fully illuminating said photoconductive layer until the electric field therein is substantially zero and then simultaneously exposing said photoconductor layer to a light image and applying between the electrodes a voltage of a second polarity opposite to said first polarity and of a value sufficient to cause gaseous discharges between the layers corresponding to the light exposed areas of the photoconductor layer whereby to produce an electrostatic latent image on said dielectric layer;

separating said members and at least partially removing said latent image from said dielectric layer; and repositioning said members with said layers in virtual contact and simultaneously illuminating said photoconductor layer and applying between said electrodes a direct current voltage of said first polarity whereby to erase residual charges on said dielectric layer.

7. The method of claim 6 wherein said electrodes are interconnected by short circuiting and electrodes while said photoconductor layer is illuminated.

8. The method of claim 6 wherein the voltage applied between said electrodes to erase said residual charges is of a value sufficient to cause the gaseous discharges between the virtually contacting layers while the photoconductor layer is illuminated.

9. The method of claim 8 comprising the step of applying a voltage of said second alternately with said voltage of first polarity between said electrodes to erase said residual charges of both polarities.

10. The method of claim 6 wherein said step of removing the latent image from said dielectric layer includes developing said latent image with toner and transferring said developed image from said dielectric layer.

11. The method of claim 10 including the step of removing residual toner from said dielectric member following the transfer of the developed image and before the step of erasing the residual charges.

* * * * *